US006594966B2

(12) United States Patent
Froeter

(10) Patent No.: US 6,594,966 B2
(45) Date of Patent: Jul. 22, 2003

(54) BI-FUNCTIONAL ROOF DRAIN AND METHOD OF RETROFITTING A ROOF DRAINAGE SYSTEM THEREWITH

(76) Inventor: Craig J. Froeter, 2439 Shoreline Heights Rd., Sterling, IL (US) 61081

( * ) Notice: Subject to any disclaimer, the term of this patent is extended or adjusted under 35 U.S.C. 154(b) by 23 days.

(21) Appl. No.: 09/992,376

(22) Filed: Nov. 6, 2001

(65) Prior Publication Data

US 2003/0084631 A1 May 8, 2003

(51) Int. Cl.[7] ..... E04D 13/04
(52) U.S. Cl. ..... 52/302.1; 284/42; 210/163
(58) Field of Search ..... 52/302.1; 4/650, 4/652, 679; 210/163; 285/42; 137/357

(56) References Cited

U.S. PATENT DOCUMENTS

| | | | | |
|---|---|---|---|---|
| 550,460 | A | * 11/1895 | Shanks | |
| 810,879 | A | 1/1906 | Perry | |
| 902,104 | A | 10/1908 | Neireiter | |
| 2,256,626 | A | * 9/1941 | Rile | |
| 2,517,195 | A | * 8/1950 | Gaspar | |
| 3,378,858 | A | * 4/1968 | Jacuzzi | |
| 3,894,302 | A | 7/1975 | Lasater | 4/211 |
| 4,073,018 | A | 2/1978 | Arrowood | 4/191 |
| D255,596 | S | 6/1980 | Johnson | D23/40 |
| 4,246,664 | A | 1/1981 | Reynolds | 4/191 |
| 4,652,365 | A | 3/1987 | Ebeling | 210/163 |
| 4,799,713 | A | 1/1989 | Uglow | 285/42 |
| 4,839,927 | A | 6/1989 | Watanabe | 4/211 |
| 4,961,848 | A | * 10/1990 | Logsdon | |
| 5,174,128 | A | 12/1992 | Bourne et al. | 62/373 |
| 5,378,356 | A | 1/1995 | Logsdon | 210/163 |
| 5,458,769 | A | 10/1995 | Johannessen | 210/613 |
| 5,526,613 | A | 6/1996 | Simeone, Jr. | 52/12 |
| 5,702,596 | A | 12/1997 | Juple et al. | 210/166 |
| 5,800,092 | A | 9/1998 | Nill et al. | 405/52 |
| 5,902,008 | A | 5/1999 | Butsuen et al. | 296/213 |
| 5,966,884 | A | * 10/1999 | Uglow | |
| 6,041,556 | A | 3/2000 | Keller | 52/11 |
| 6,056,014 | A | 5/2000 | Kojima et al. | 138/39 |

OTHER PUBLICATIONS

Josam Company, Drawing No. A–15357–K Roof Drain Combination Aug. 15, 2001.

* cited by examiner

*Primary Examiner*—Robert Canfield
(74) *Attorney, Agent, or Firm*—Leydig, Voit & Mayer, Ltd.

(57) ABSTRACT

A bi-functional roof drain includes a housing forming a drain manifold and a primary drain outlet to connect to a primary drainage system. A backup drain pipe penetrates the housing and extends through the manifold. The top of the backup drain pipe is positioned a distance above the housing, which may be variable. With this drain a method of retrofitting a roof drainage system to provide primary and backup water drainage is also presented. This method includes removing an existing uni-functional roof drain from a deck penetration through the roof, and installing a bi-functional roof drain in the same deck penetration. The two drain outlets are connected to the primary and backup drainage system. The height of a top opening of a backup drain pipe of the bi-functional roof drain may be adjustable in relation to a surface of the roof.

19 Claims, 7 Drawing Sheets

30
32
34
10
36
42
42
26
18
16
22
20
44
12
24
14
38
38
28

BI-FUNCTIONAL ROOF DRAIN AND METHOD OF RETROFITTING A ROOF DRAINAGE SYSTEM THEREWITH

FIELD OF THE INVENTION

The present invention relates generally to building roof water drainage systems, and more particularly to roof drains for flat roofs.

BACKGROUND OF THE INVENTION

Commercial and industrial buildings are typically constructed with flat or near flat roofs. Because these buildings do not have much if any of a pitch to the roof the collection of water on the roof surface resulting from rain and melting snow could present a serious structural load that could result in collapse of the roofs structure. To avoid this possibility most commercial and industrial building standards require that roofs of this type include drains positioned at locations that ensure that at least the majority of water accumulation may be removed from the roof through a drainage plumbing system.

Typical roof drains are installed on flat roofs by cutting a hole through the roof deck and installing a drain there through. The drain typically connects with drainage plumbing that carries the water away. The drain structure typically includes some form of flashing or collar that, through the application of sealant or other roof material prevents leakage at the site of the drain installation. These typical drain structures also include some form of drain ring and under deck clamping ring or structure that holds the drain in place and prevents its inadvertent removal or dislodgement from its installed position. The opening of the roof drain is typically covered by some form of grating or strainer structure to prevent the ingestion of large objects into the drain plumbing system. In most roof drain structures this strainer or grate takes the form of a hemispherical strainer to prevent or minimize the occurrence of obstruction of the roof drain through the accumulation of leaves and other debris that may accumulate on the roof.

Unfortunately, despite the inclusion of a strainer or other grating structure, many roof drains still become plugged or otherwise obstructed to the point that inhibits their ability to remove the accumulated water from the roof of the building. These obstructions can occur as a result of the collection of debris around or over the grate or strainer structure. Additionally, obstructions may also result in the roof drain system during winter months as a result of icing near the roof level of the open areas of the strainer. In addition to the obvious problems resulting from complete obstruction of the roof drains, minor obstructions that merely result in the reduction in the rate of water removal from the roof may also result in undo stress on the roof structure that may endanger its integrity. Additionally, even unobstructed roof drains may not be able to remove water at a rate to prevent its undue accumulation during periods of heavy storms and intense rainfall.

In recognition of the limitations of a single roof drain system, many building codes and many more contractors are installing backup roof drains connected to separate drainage system to ensure that the load carrying capacity of a roof structure is not exceeded if the primary roof drain system fails to remove the water accumulation at a sufficient rate. These backup roof drains are typically constructed in the same manner as the primary roof drains, but include a structure that prohibits the drainage of water through the backup drainage system until the level of the water reaches a predetermined depth. That is, the entry ports or slots on the backup roof drains are positioned at a height above the roof surface. This height is preferably chosen based upon the roof construction such that the weight of the water at that given height is well within the load carrying of the roof structure. The separate drainage system ensures that failure of the primary roof drain system due to an obstruction in the drainage system downstream from the roof drains will not effect the ability of the backup roof drain system to remove the water that accumulates above a given depth.

While the usage of a primary and backup roof drain system greatly enhances the safety of the roof construction, such also greatly increases the cost of the roof construction. This significant cost increase is a result of the requirement for essential double the number of roof drains that must be installed on the roof. Since typical primary and backup roof drains are of the same construction differing only in the strainer or inlet structure, the cost for such roof drains is essentially double. In addition to the increased cost necessitated by the purchase of twice as many roof drains, each roof drain requires a separate deck penetration or hole to be cut in the roof structure. This essentially doubles the labor cost associated with such a system as twice as many roof penetrations must be cut. Further, depending on the number of primary and backup roof drains that are installed, the overall structural strength of the roof may be weakened due to the large number of deck penetrations that are cut to accommodate both the primary and backup roof drains.

While these factors may be considered in the design of a new construction, and therefore compensated, the cost and structural impact to existing buildings that may wish to or are required to install such a backup roof drain system can be prohibitive. That is, on an existing building the roofs structure and strength are already set, and any impact thereto resulting from the installation of the backup roof drains is not easily compensated. Additionally, the roof surface itself may already be occupied by other equipment that limits the ability to properly position additional backup roof drains to maximize their effectiveness. Further, additional roof penetrations by other system within a building may also limit the ability to install the backup drains at appropriate locations due to clearance requirements dictated by the roof penetrations of the other systems. As a result, the retrofit of an existing building to install the backup roof drain system often is not only expensive but also quite problematic if it can be installed at all.

BRIEF SUMMARY OF THE INVENTION

In view of the above, it is a general aim of the invention to provide a new and improved roof drain for flat roofs. More particularly, it is a general aim of the present invention to provide a new and improved roof drain that provides both primary and backup water drainage for flat roofs. Additionally, it is a general aim of the present invention to provide such a bi-functional roof drain for initial installations on new constructions, and for retrofitting existing structures to include the backup drainage capability. Preferably, this retrofitting may be accomplished without the necessity of cutting additional roof deck penetrations.

In one embodiment of the present invention, a bi-functional roof drain comprises a drain housing having bottom and side walls forming a drain manifold. The drain housing further includes a primary drain outlet in communication with the drain manifold and is adapted to connect to a primary drainage system of a building. A strainer basket is positioned over an open top of the drain housing. Additionally, a backup drain pipe sealingly penetrates the drain housing and extends through the drain manifold and the strainer basket. This backup drain pipe has a top opening positioned a vertical distance above the open top of the drain housing. The backup drain pipe further includes a backup drain outlet adapted to connect to a backup drainage system of a building.

In a further embodiment the backup drain pipe penetrates the bottom wall, and the drain further comprises a gasket positioned-in sealing arrangement between the bottom wall and the backup drain pipe. In one embodiment the backup drain pipe translatably extends through the drain manifold such that the vertical distance from the open top of the drain housing to the top opening of the backup drain pipe is variable. Preferably, the strainer basket includes clamping means positioned to securely retain the backup drain pipe at a given vertical position. In an alternate embodiment wherein the backup drain pipe translatably penetrates the bottom wall, the drain further comprises a gasket positioned in sealing arrangement between the bottom wall and the backup drain pipe. In yet a further embodiment, the backup drain pipe includes an extendable section within the drain manifold to accommodate variation of the vertical distance from the open top of the drain housing to the top opening of the backup drain pipe.

In one embodiment of the bi-functional roof drain, the drain housing and the backup drain pipe are formed as a unitary structure. In another embodiment the backup drain pipe includes a plurality of openings positioned in proximity to the top opening. Preferably, the bi-functional roof drain further comprises a cap positioned over the top opening of the backup drain pipe. In one embodiment the primary drain outlet and the backup drain outlet are positioned to accommodate retrofitting of a uni-functional roof drain to provide backup drainage of accumulated water on a roof.

The present invention also embodies a method of retrofitting a roof drainage system to provide primary and backup water drainage. This method of retrofitting comprises the steps of removing an existing uni-functional roof drain from a deck penetration through the roof, and installing a bi-functional roof drain in the deck penetration. Preferably, the method further comprises the steps of installing a backup roof drainage system, connecting a primary drain outlet of the bi-functional roof drain to the roof drainage system, and connecting a backup drain outlet of the bi-functional roof drain to the backup roof drainage system.

In an alternate embodiment of the method of the present invention, the method further comprises the step of adjusting a vertical height of a top opening of a backup drain pipe of the bi-functional roof drain in relation to a surface of the roof. Preferably, the step of adjusting includes the steps of determining a water load bearing limit for the roof and setting the vertical height of the top opening of the backup drain pipe such that the water load bearing limit will not be exceeded if the primary drain outlet is plugged.

In yet a further alternate embodiment, a bi-functional roof drain is presented that comprises a drain housing forming a drain manifold therein having an open top, a primary drain outlet in communication with the drain manifold, and a backup drain pipe extending through and isolated from communication with the drain manifold. The backup drain pipe has a top opening positioned a vertical distance above the open top of the drain housing. The backup drain pipe further includes a backup drain outlet. Preferably, the bi-functional roof drain further comprises a strainer basket positioned over the open top. The drain pipe extends through the strainer basket. In one embodiment, the drain housing, the primary drain outlet and the backup drain pipe are formed as a unitary structure. Preferably, the unitary structure is molded. In yet an additional embodiment of the present invention, a distance between the top opening of the backup drain pipe and the open top of the drain housing is adjustable.

Other aims, advantages, and features of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
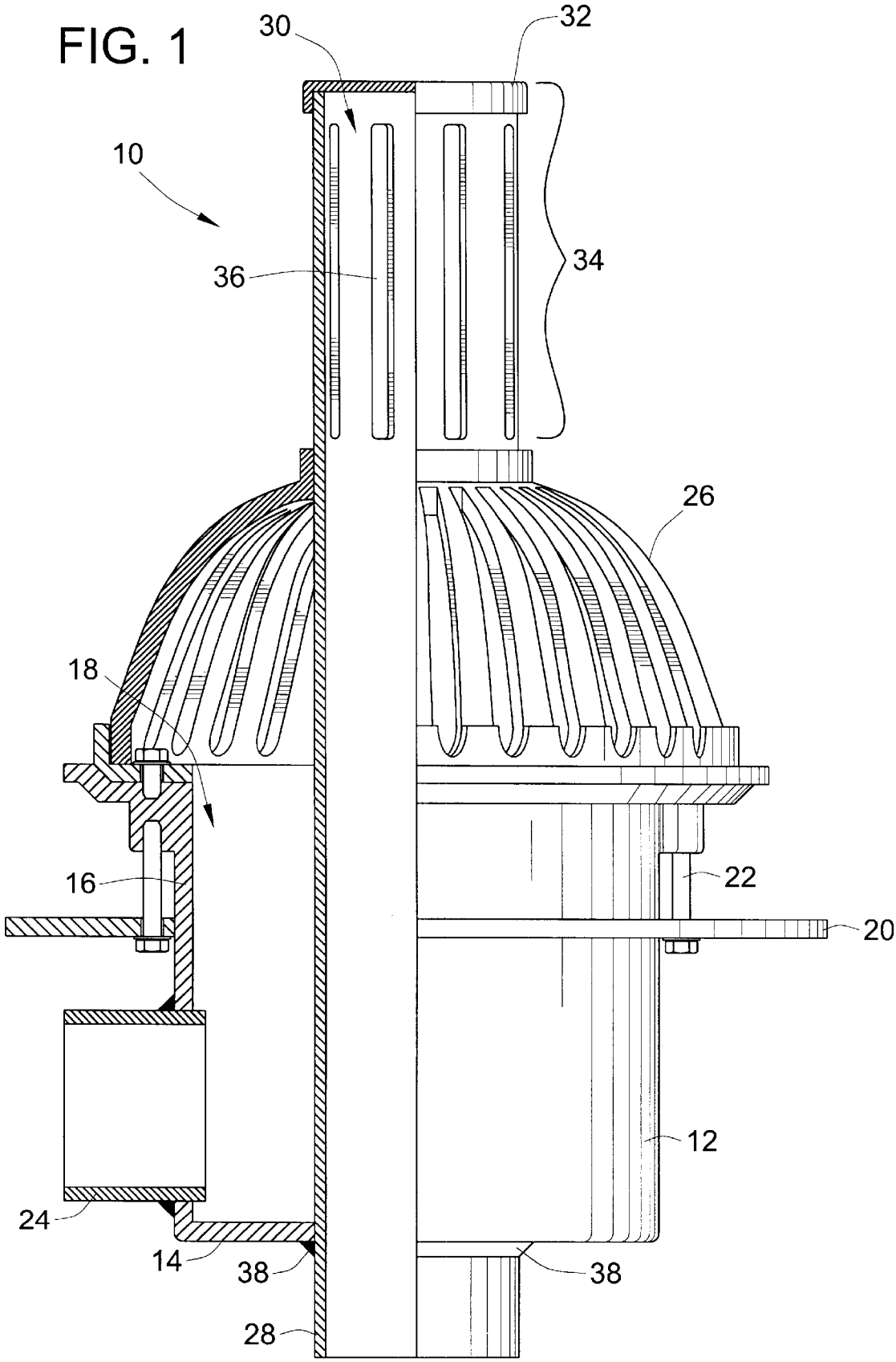
FIG. 1 is a partial cross-section elevation view of an embodiment of a bi-functional roof drain constructed in accordance with the teachings of the present invention.

Turning now to FIG. 1 there is illustrated a bi-functional roof drain 10 constructed in accordance with the teachings of the present invention, shown in partial cut-away to illustrate some of the features thereof. The bi-functional roof drain 10 includes a drain housing 12 having bottom 14 and side 16 walls. These walls 14, 16 form a drain manifold 18 having an open top. An under deck clamping ring 20 with associated bolts 22 may be included, as is conventional, to secure the bi-functional roof drain in its installed position on a roof in a known manner.

The drain housing 12 includes a primary drain outlet 24 in communication with the drain manifold 18. This primary drain outlet 24 is preferably adapted to connect to a primary drainage system of a building so that water that drains into the drain manifold 18 may be removed through primary drain outlet 24 to the main drainage system. To prevent the accumulation of debris within the drain manifold 18, the bi-functional roof drain 10 may also include a strainer basket 26 positioned over the open top of the drain housing 12. This strainer basket may take various forms as are known in the art such that large debris is precluded from entering the drain manifold 18 but water may freely flow into the manifold 18 without undue restriction. While the strainer 26 may take various forms, it is preferred that the structure extend vertically from the plane of the open top to minimize the possibility of simple obstruction by leaves or other debris that may more easily obstruct a flat grate.

The bi-functional roof drain also includes a backup drain pipe 28 that sealingly penetrates the drain housing 12 and extends through the drain manifold 18. In the embodiment illustrated in FIG. 1, the backup drain pipe 28 also extends through the strainer basket 26, although one skilled in the art will recognize that the geometry of strainer basket 26 may be such to cover not only the open top of the drain manifold 18 but also the backup drain pipe 28 in one embodiment. The backup drain pipe 28 has a top opening 30 that is positioned a vertical distance above the open top of the drain housing 12. This top opening 30 may be covered with an appropriate cap 32 to prevent the ingestion of large debris that may block the backup drain system, although this cap 32 is entirely optional. If used, this cap 32 may include a strainer structure that will allow fluids to easily flow there through while providing the appropriate degree of foreign object filtering.

Additionally, the upper end 34 of the backup drain pipe 28 may also include a plurality of openings 36 that also allow fluids to pass there through without undue restriction while providing an appropriate degree of foreign object filtering. With such a structure, the functional top opening of the backup drain pipe 28 may be considered to include these openings 36 because any water that rises to the bottom of such openings will begin to drain into the backup drain system. To simplify the discussion, however, this functional top opening will be referred to simply as the top opening 30 of the backup drain pipe 28.

In the embodiment illustrated in FIG. 1, the backup drain pipe 28 penetrates the drain housing 12 through the bottom wall 14, and is adapted to connect to a backup drainage system of the building. In this embodiment, the sealing engagement between the bottom wall 14 and the backup drain pipe 28 may be provided through the application of an appropriant sealant 38 to prevent any leaks between the bottom wall 14 and the backup drain pipe 28. As an alternative to the usage of a water tight sealant, the sealing engagement between the backup drain pipe 28 and the bottom wall 14 of the housing 12 may be accomplished by a weld.

Operation of the bi-functional roof drain 10 once installed on the roof of a building is essentially conventional during normal, primary drainage system operation. That is, until and unless the primary drainage system becomes blocked, overloaded, or restricted to a degree that an amount of water cannot be removed through the drainage system to prevent undue accumulation of water on the roof, operation of the bi-functional roof drain 10 is indistinguishable from conventional uni-functional roof drains. As water begins to accumulate on the roof, it flows through the strainer 26 into the drain manifold 18 and through the primary drain outlet 24 to be carried away by the primary drainage system of the building.

If a collection of debris obstructs the openings in the strainer 26 and water begins to accumulate on the roof, eventually it will rise to a level of the top opening 30 of the backup drain pipe 28. At that point, the accumulated water on the roof above this level will begin to flow through openings 36 and through the backup drain pipe 28 to a backup drainage system of the building. Because the backup drain pipe 28 extends through the manifold 18, even if the obstructions in the primary drainage system are as a result of an accumulation of debris within the manifold 18, the drain pipe 28 will not be effected by the debris therein. In this way, the bi-functional roof drain 10 of the present invention provides for both primary and backup roof water drainage at a single location, while maintaining a required isolation between these two drainage systems to minimize the ability of a single obstructing event causing undue accumulation of water on the roof of a building.

Figure 2:
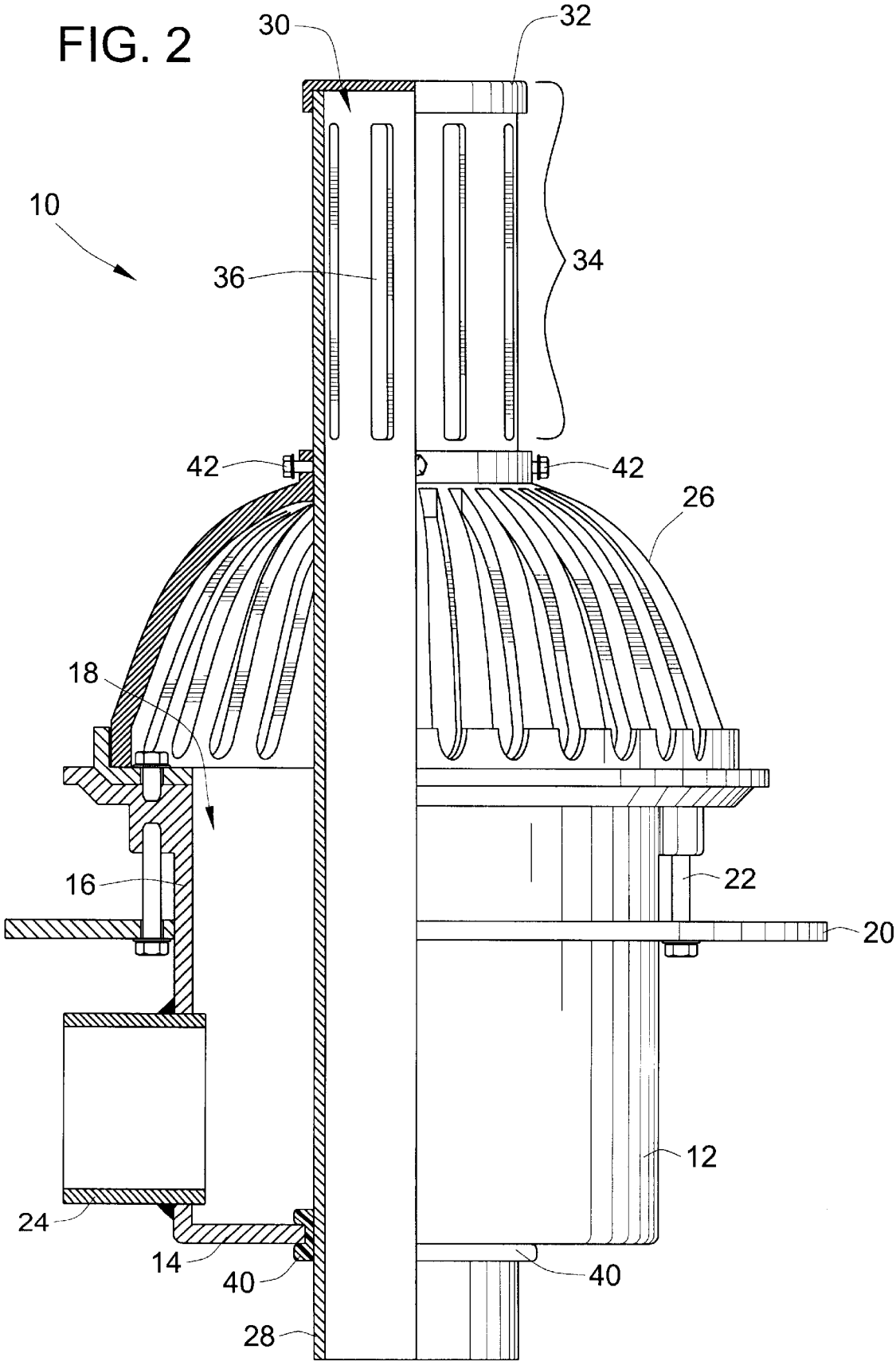
FIG. 2 is a partial cut-away side elevation view of an alternate embodiment of the bi-functional roof drain constructed in accordance with the teachings of the present invention.

An alternate embodiment of the present invention is illustrated in FIG. 2, to which specific reference is now made. While the embodiment of FIG. 1 provided the sealing engagement between the drain housing 12 and the backup drain pipe 28 through the usage of a sealant, weld, etc., the embodiment illustrated in FIG. 2 provides the sealing engagement through the usage of a gasket 40 positioned between the backup drain pipe 28 and the housing 12. By utilizing a gasket 40, the backup drain pipe 28 may be slidingly positioned in relation to the housing 12 such that the top opening 30 of the backup drain pipe 28 may be varied in relation to the open top of the drain housing 12. This sliding engagement made possible by the usage of the gasket 40 allows proper positioning of the backup drain pipe so that the backup drainage system is used to drain accumulated water only at an appropriate level. That is, the structural integrity of the roof may be used to determine the level of accumulated water that will be allowed to exist on the roof before the backup drainage system is called into play.

Further, irregularities in the surface of the roof may also be taken into account to ensure that once the backup drainage system is required, all or the appropriate backup drains positioned at different locations on the roof begin to operate. This may require that roof drains positioned at locations that may be slightly higher than other locations may have the vertical position of the top opening 30 lowered so that it is in the same horizontal plane as the top opening 30 of the other backup drain pipes of bi-functional roof drains installed at lower locations on the roof.

Once an appropriate vertical position of the top opening 30 of backup drain pipe 28 is determined, it may be held in place by clamping means, such as, for example, the inclusions of set screws 42 which may be tightened against the surface of backup drain pipe 28 to hold it in place. Other appropriate means may include the application of an adhesive, the tightening of a band, or other known means in the art. Preferably, the clamping means prevents both upward and downward dislodgement of the top opening 30 of the backup drain pipe 28. However, if a clamping means is utilized that will only provide unidirectional movement prevention, it is preferred that the backup drain pipe 28 be secured against upward vertical dislodgement because such may allow additional water to be accumulated on a roof before it will be drained away by the backup drain pipe 28, possibly increasing the structural load on the roof beyond a safe level. While downward dislodgement is not desired, such will provide additional safety to ensure that the maximum amount of water that can be sustained is not exceeded.

Figure 3:
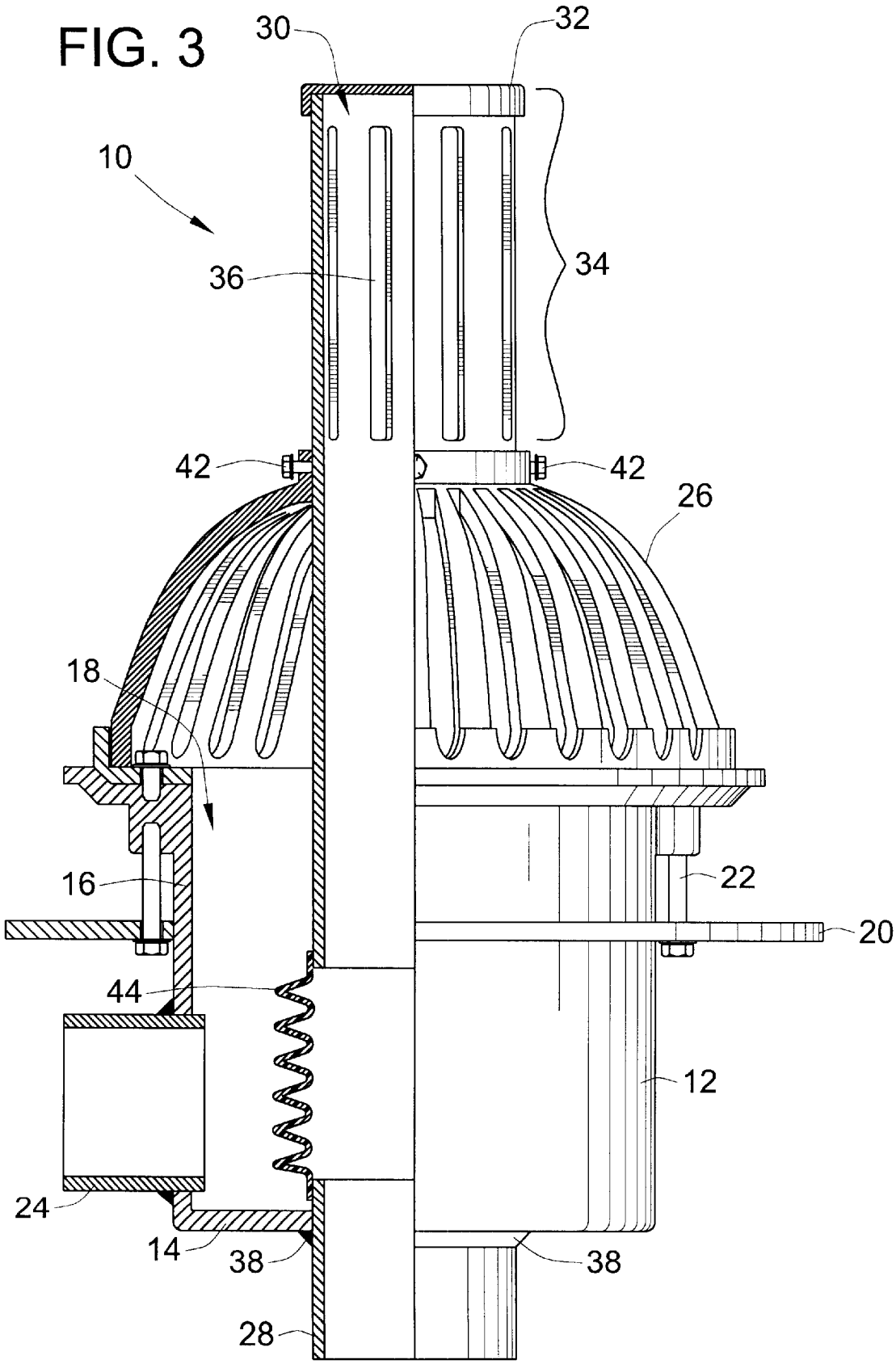
FIG. 3 is a partial cut-away side elevation view of a further alternate embodiment of the bi-functional roof drain constructed in accordance with the teachings of the present invention illustrating a backup drain pipe in a compressed position.
Figure 4:
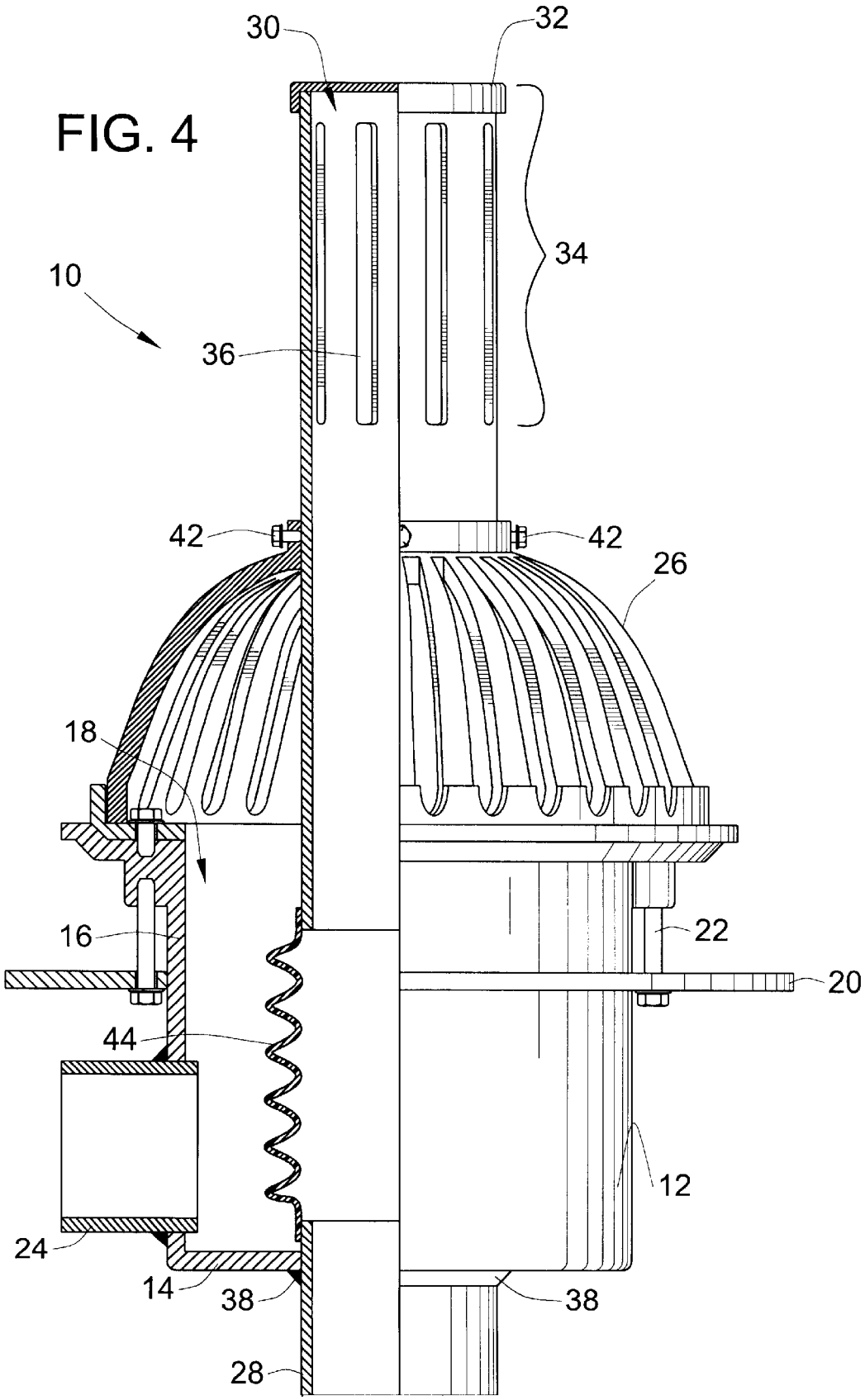
FIG. 4 is a partial cut-away side elevation view of the alternate embodiment of the bi-functional roof drain illustrated in FIG. 3 illustrating the backup drain pipe in an extended position.

To provide this measure of vertical height adjustability of the top opening 30 of the backup drain pipe 28 in embodiments of the bi-functional roof drain that utilize a sealant or weld 38 as opposed to a gasket 40, an extendable/collapsible section 44 may be included in the drain pipe 28 as illustrated in FIG. 3. This extendable section 44 provides for a minimum height of the top opening 30 of the backup drain pipe 28 when fully collapsed, and a maximum height (see FIG. 4) when the section 44 is fully extended. The vertical height of the top opening 30 of the backup drain pipe 28 may be adjusted anywhere between these two extremes shown in FIG. 3 and FIG. 4. If additional height is necessary, an additional or longer section may be used or added to the backup drain pipe 28 as appropriate. When the extendable section 44 is utilized, some form of clamping means, such as set screws 42 should be utilized so that the vertical position of the top opening 30 may not be inadvertently changed as discussed above.

Figure 5:
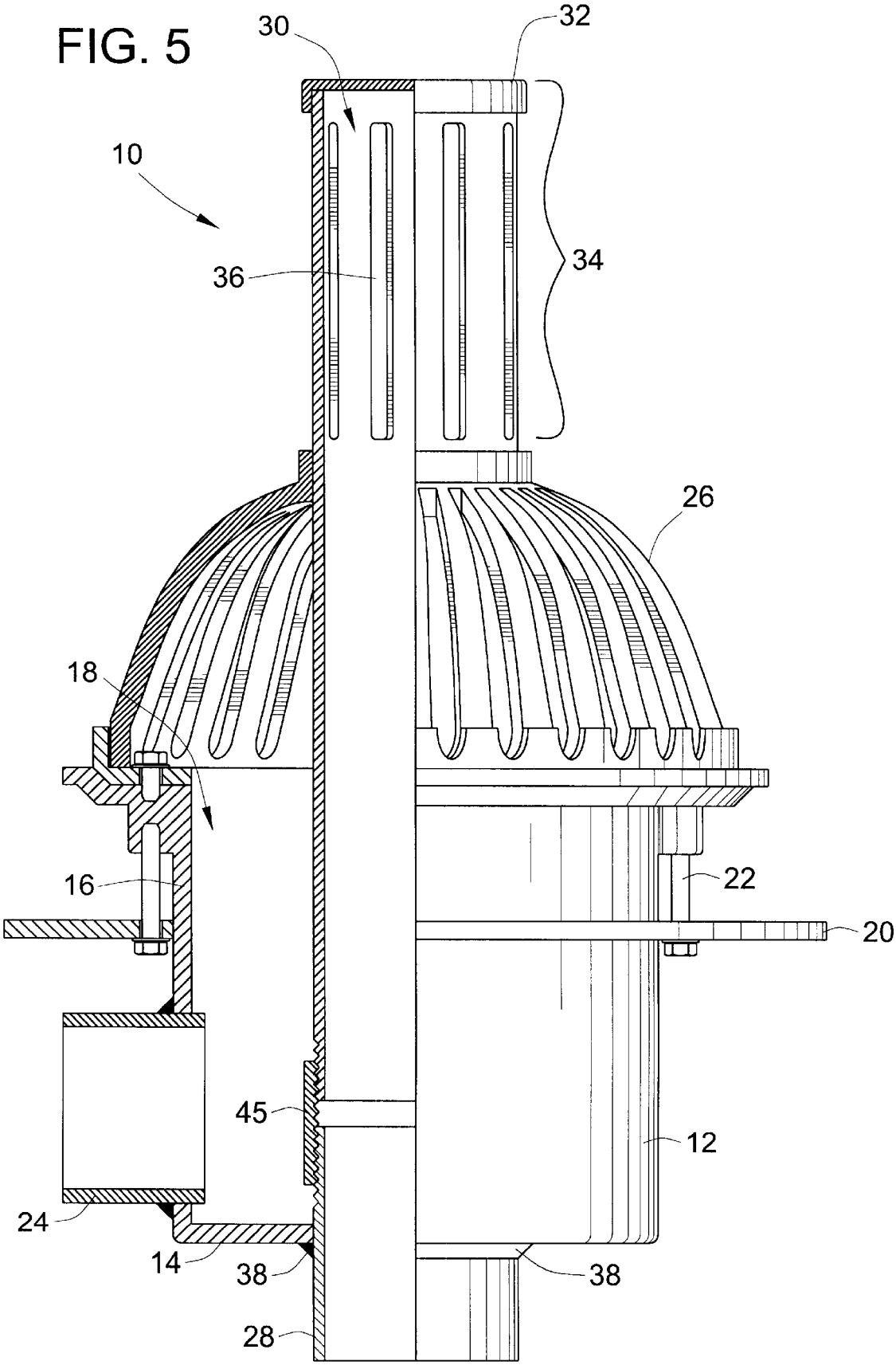
FIG. 5 is a partial cut-away side elevation view of a further additional alternate embodiment of the bi-functional roof drain constructed in accordance with the teachings of the present invention.

Vertical height adjustability of the top opening 30 of the backup drain pipe 28 may also be provided, as illustrated in the embodiment of FIG. 5, by providing a threaded fitting 45 that allows different lengths of backup drain pipe 28 to be used. The length of the backup drain pipe 28 used would determine the height of the top opening, and can be adjusted on-site with appropriate pipe fitting tools. Alternatively, the bottom wall 14 could merely be threaded to accept backup drain pipes 28 of different lengths in sealing engagement to simplify the construction.

Figure 6:
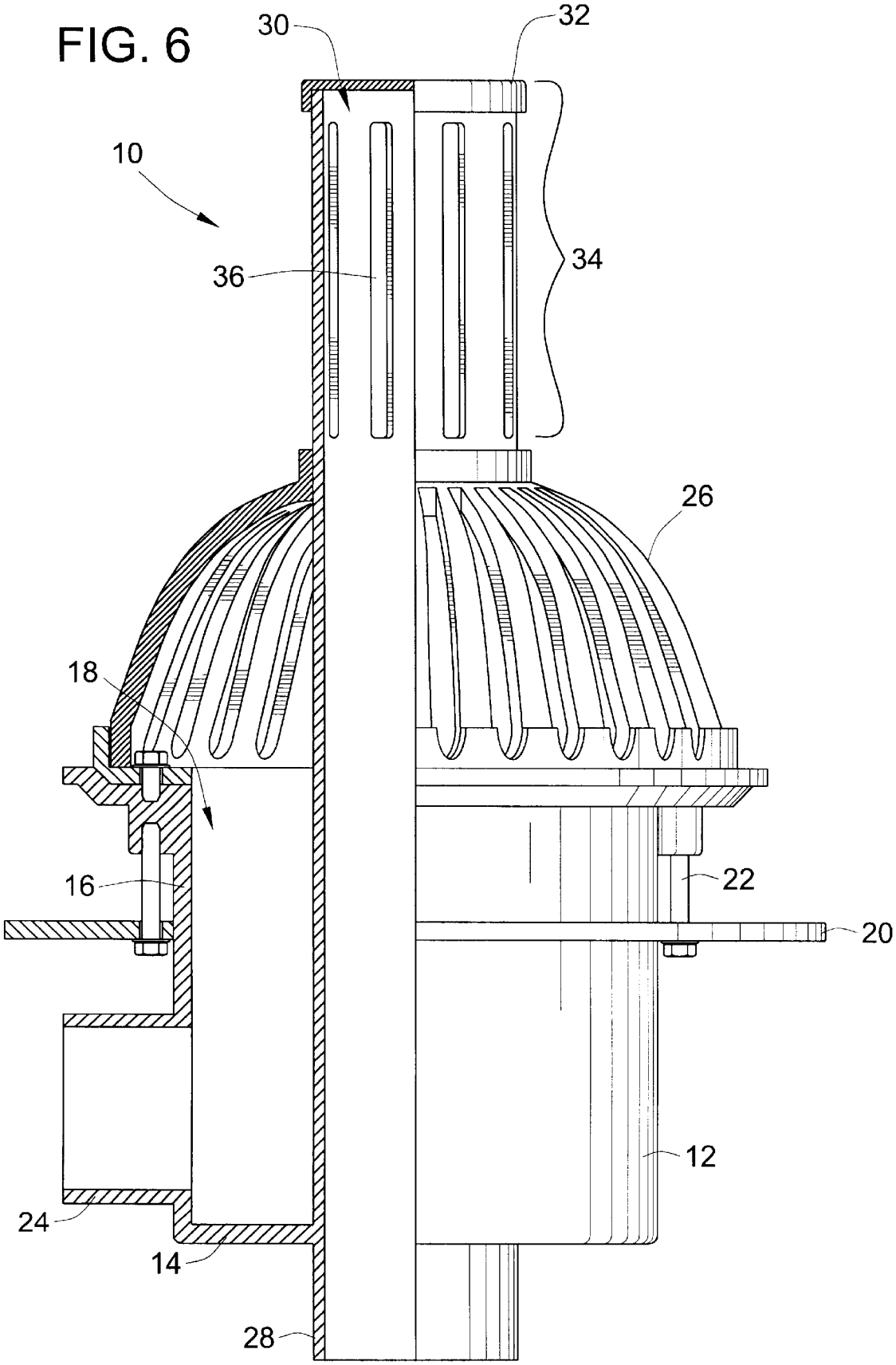
FIG. 6 is a partial cut-away side elevation view of an additional alternate embodiment of the bi-functional roof drain constructed in accordance with the teachings of the present invention.

The embodiment of the present invention illustrated in FIG. 6 utilizes a unitary construction of the drain housing 12 and the backup drain pipe 28. As may be seen in the cut-away section of this FIG. 6, a unitary construction forming the backup drain pipe 28, the bottom wall 14, the primary drain outlet 24, and the side walls 16 is illustrated. Such construction may be provided by, for example, molding the construction. Materials appropriate for drainage applications may be utilized, including PVC or other plastic, rubberized, or polymer material as appropriate for the particular application. The molding process may take into account the appropriate height of the top opening 30 of the backup drain pipe 28, or alternatively a standard height can be provided that may be cut to fit by the installation personnel.

Figure 7:
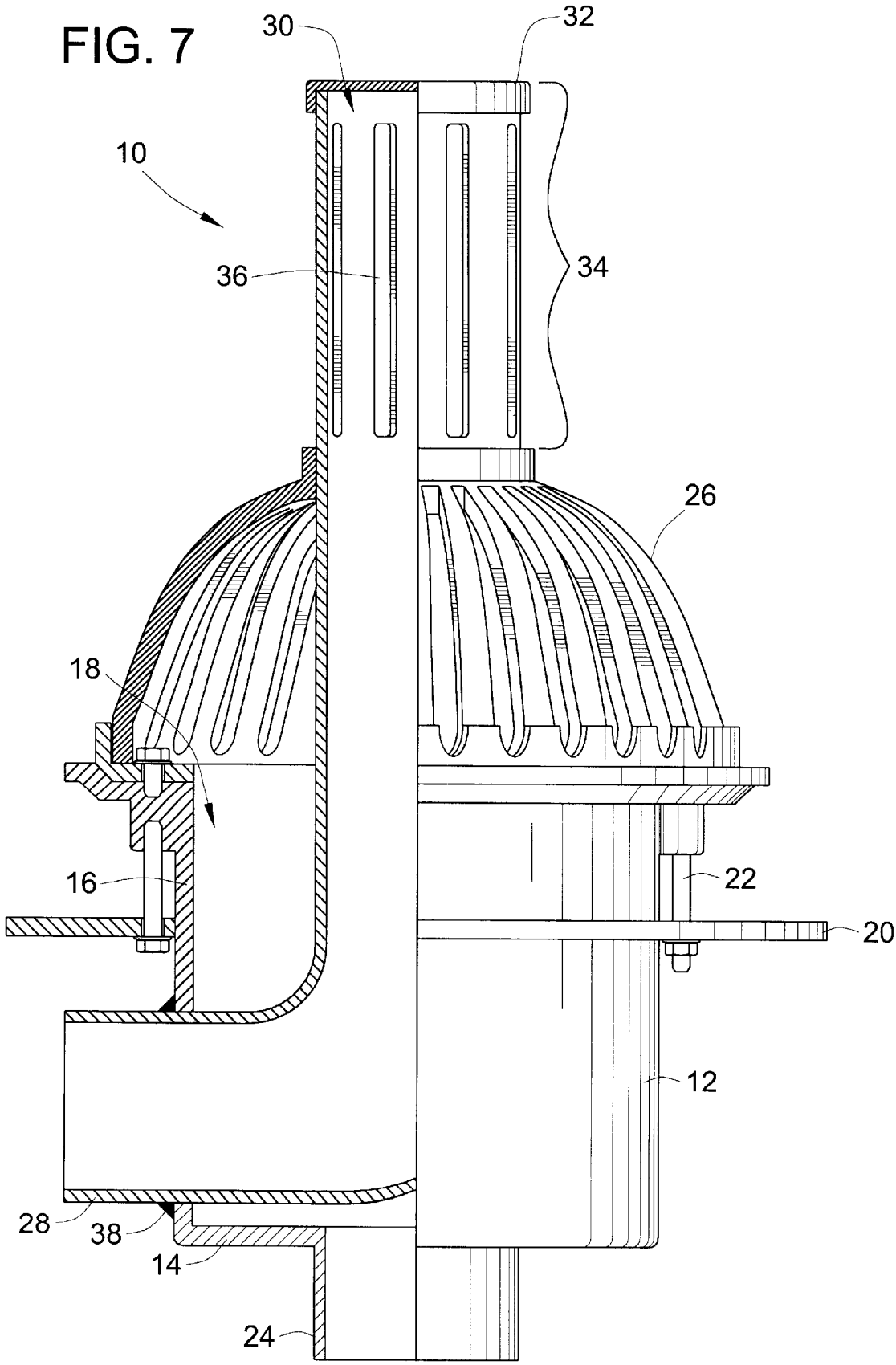
FIG. 7 is a partial cut-away side elevation view of yet an other alternate embodiment of the bi-functional roof drain constructed in accordance with the teachings of the present invention.

An alternate embodiment of the present invention particularly adapted to accommodate retrofitting of a uni-functional roof drain to provide both primary and backup drainage of accumulated water on a roof is illustrated in FIG. 7. In this embodiment, the primary drain outlet 24 is located at a position that allows it to connect to the primary drainage system of the roof to which the uni-functional drain has previously connected. This is typically in the center of the drain structure. The backup drain pipe 28, and in particular the backup drain outlet 28, is relocated to a non-interfering position with the primary outlet 24. This non-interfering location can exist though the bottom 14 or side 16 walls. In the embodiment illustrated in FIG. 7 this backup drain outlet 28 sealingly engages the side wall 16 so that it may be connected to the backup drainage system added during the retrofit of the roof drain system of the building. In an embodiment having the non-interfering location being in the bottom wall 14, an angled or S-shaped section in the backup drain pipe 28 would be used instead of the 90° section illustrated in FIG. 7. While these embodiments are discussed as being particularly relevant to a retrofit operation, it is noted that any of the embodiments illustrated and those that come within the scope of the present invention may be used in a retrofit operation with appropriate plumbing to connect the primary drain outlet to the primary drainage system and the backup drain outlet to the backup drain system.

Such a retrofit operation is highly desirable as it eliminates the necessity to drill or cut additional roof deck penetrations to install the backup roof drains on a building that already includes the uni-functional roof drains providing only a single drainage system. Additionally, the bi-functional roof drain of the present invention also allows the retrofit to be accomplished with enlarging the deck penetration used by the uni-functional roof drain. The process for performing such a retrofit operation requires that the existing uni-functional roof drain be removed from the deck penetration through the roof. Once this uni-functional roof drain has been removed, a bi-functional roof drain constructed in accordance with the teachings of the present invention may then be installed through the same roof penetration. Once the backup roof drainage system plumbing has been installed within the building, the primary drain outlet of the bi-functional roof drain is connected to the roof drainage system existing in the building, and the backup drain outlet of the bi-functional roof drain is connected to the backup roof drainage system.

As discussed above, the vertical height of the backup drainage system may be adjusted in relation to the surface of the roof to take into account the load bearing limit of the roof and the surface profile of the roof to ensure that proper backup drainage occurs. This may result in the bi-functional roof drains having different heights for the top opening of the backup drain pipe to properly effectuate the drainage of accumulated water on the roof before the load bearing limit is exceeded. This may also result in lower vertical heights for the top opening of the backup drain pipe in areas of weaker construction so that less water needs to be accumulated before the backup drainage system operates to drain the additional water.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A bi-functional roof drain, comprising:

a drain housing having bottom and side walls forming a drain manifold therein, the drain housing further including a primary drain outlet in communication with the drain manifold and adapted to connect to a primary drainage system of a building;

a strainer basket positioned over an open top of the drain housing; and a backup drain pipe sealingly penetrating the drain housing and extending through the drain manifold and the strainer basket, the backup drain pipe having a top opening positioned a vertical distance above the open top of the drain housing, the backup drain pipe further including a backup drain outlet adapted to connect to a backup drainage system of a building.

2. The bi-functional roof drain of claim 1, wherein the backup drain pipe penetrates the bottom wall, the drain further comprising a gasket positioned in sealing arrangement between the bottom wall and the backup drain pipe.

3. The bi-functional roof drain of claim 1, wherein the backup drain pipe translatably extends through the drain manifold such that the vertical distance from the open top of the drain housing to the top opening of the backup drain pipe is variable.

4. The bi-functional roof drain of claim 3, wherein the strainer basket includes clamping means positioned to securely retain the backup drain pipe at a given vertical position.

5. The bi-functional roof drain of claim 3, wherein the backup drain pipe translatably penetrates the bottom wall, the drain further comprising a gasket positioned in sealing arrangement between the bottom wall and the backup drain pipe.

6. The bi-functional roof drain of claim 3, wherein the backup drain pipe includes an extendable section within the drain manifold to accommodate variation of the vertical distance from the open top of the drain housing to the top opening of the backup drain pipe.

7. The bi-functional roof drain of claim 1, wherein the drain housing and the backup drain pipe are formed as a unitary structure.

8. The bi-functional roof drain of claim 1, wherein the backup drain pipe includes a plurality of openings positioned in proximity to the top opening.

9. The bi-functional roof drain of claim 8, further comprising a cap positioned over the top opening of the backup drain pipe.

10. The bi-functional roof drain of claim 1, wherein the primary drain outlet and the backup drain outlet are positioned to accommodate retrofitting of a uni-functional roof drain to provide backup drainage of accumulated water on a roof.

11. A bi-functional roof drain, comprising:

a drain housing forming a drain manifold therein having an open top;

a primary drain outlet in communication with the drain manifold; and a backup drain pipe extending through and isolated from communication with the drain manifold, the backup drain pipe having a top opening positioned a vertical distance above the open top of the drain housing, the backup drain pipe further including a backup drain outlet.

12. The bi-functional roof drain of claim 11, further comprising a strainer basket positioned over the open top.

13. The bi-functional roof drain of claim 12, wherein the drain pipe extends through the strainer basket.

14. The bi-functional roof drain of claim 11, wherein the drain housing, the primary drain outlet and the backup drain pipe are formed as a unitary structure.

15. The bi-functional roof drain of claim 14, wherein the unitary structure is molded.

16. The bi-functional roof drain of claim 11, wherein a distance between the top opening of the backup drain pipe and the open top of the drain housing is adjustable.

17. A method of retrofitting a roof drainage system to provide primary and back up water drainage, comprising the steps of:

removing an existing uni-functional roof drain from a deck penetration through the roof; and installing a bi-functional roof drain in the deck penetration;

installing a backup roof drainage system;

connecting a primary drain outlet of the bi-functional roof drain to the roof drainage system; and connecting a backup drain outlet of the bi-functional roof drain to the backup roof drainage system.

18. A method of retrofitting a roof drainage system to provide primary and backup water drainage comprising the steps of:

removing an existing uni-functional roof drain from a deck penetration through the roof: and installing a bi-functional roof drain in the deck penetration; and adjusting a vertical height of a top opening of a backup drain pipe of the bi-functional roof drain in relation to a surface of the roof.

19. The method of claimed 18, wherein the step of adjusting includes the steps of determining a water load bearing limit for the roof and setting the vertical height of the top opening of the backup drain pipe such that the water load bearing limit will not be exceeded if the primary drain outlet is plugged.

* * * * *